United States Patent [19]

Sogge

[11] 3,990,406

[45] Nov. 9, 1976

[54] ROTO-RECIPROCATING ENGINE

[76] Inventor: Roger L. Sogge, Rte. 3, Box 1094, Troutdale, Oreg. 97060

[22] Filed: Apr. 14, 1975

[21] Appl. No.: 567,544

Related U.S. Application Data

[63] Continuation of Ser. No. 885,214, Dec. 15, 1969, abandoned.

[52] U.S. Cl. ..... 123/8.45; 418/61 R; 418/62

[51] Int. Cl.[2] ..... F02B 55/14; F01C 1/02

[58] Field of Search ..... 123/8.45; 418/61 R, 418/62, 67

[56] References Cited

UNITED STATES PATENTS

| | | | |
|---|---|---|---|
| 879,213 | 2/1908 | Tew | 418/61 R |
| 1,197,578 | 9/1916 | Jackson | 418/61 R |
| 1,227,173 | 5/1919 | Moors | 418/62 |
| 1,350,159 | 8/1920 | Johnson | 418/61 R |
| 1,525,364 | 2/1925 | Brett | 123/8.45 |
| 2,783,714 | 3/1957 | Straatveit | 418/62 |
| 3,076,446 | 2/1963 | Lockhart | 123/8.45 |

FOREIGN PATENTS OR APPLICATIONS

| | | | |
|---|---|---|---|
| 1,329,661 | 5/1963 | France | 418/61 R |
| 295,146 | 4/1965 | Netherlands | 128/8.45 |
| 964,083 | 7/1964 | United Kingdom | 123/8.45 |

*Primary Examiner*—William L. Freeh
*Attorney, Agent, or Firm*—Klarquist, Sparkman, Campbell, Leigh, Hall & Whinston

[57] ABSTRACT

The invention relates to a roto-reciprocating engine combining the reciprocating principle with rotary movement by using an orbiting non-rotating piston and sliding chamber seals to form positive displacement chambers distributed radially around the crankshaft.

9 Claims, 14 Drawing Figures

ROTO-RECIPROCATING ENGINE

This is a continuation of application Ser. No. 885,214 filed Dec. 15, 1969 now abandoned.

In the specifications, the invention is described as an internal combustion engine. The same basic mechanism can be built for use as a steam engine, a hydraulic pump or motor, an air motor or compressor, and the term engine is intended to include any and all such uses of the invention.

In brief the engine consists of a chamber comprised of a front and back wall separated by an annular block having in its shape provisions for seals and valving mechanisms. In the chamber formed by these three members is a piston mounted on a crankshaft whose output end extends through the back wall. The front wall has a clearance hole through which extends a member secured to the piston inside the chamber and which is attached to an orientation mechanism on the outboard side of the front wall, said combination of members and mechanisms making it possible for the piston to orbit around the crankshaft center while remaining in a substantially oriented position. Pivotally mounted on the piston are sliding chamber seal members which extend through rotatable seals in the block and which together with the crankshaft, piston, block, and walls form chambers which are expansible but uniformly oriented in relation to the walls and block.

A primary object of the invention is to provide an engine that has large cubic inch displacement per pound of unit weight and therefore a good horsepower to weight ratio.

A further object of the invention is to maintain the reciprocating principle and combine it with rotary motion in radially located chambers so the power impulses and the heat generated thereby are evenly distributed around the engine periphery.

Another object is to so concentrate the power unit that one piston and one crank on the output shaft serve all chambers of the engine.

Still another object of the invention is to provide an engine in which all sealing mechanisms and contact surfaces are either straight and flat or else circular in shape thereby giving longer lasting and easier to manufacture seals.

Another object of the invention is to provide an engine in which all close tolerance dimensions are embodied in a configuration that is easy to manufacture and maintain.

It is also an object of the invention to provide an engine with the reciprocating principle but having a minimum number of reciprocating parts to minimize the amount of weight that must change directions abruptly.

Additionally, it is an object of the invention to provide a versatile engine unit that has several forms of internal and external combustion, compressor and pump uses.

There are still other advantages and objects of the invention that will become apparent in reading the detailed description and specifications and by studying the accompanying drawings.

Figure 1:
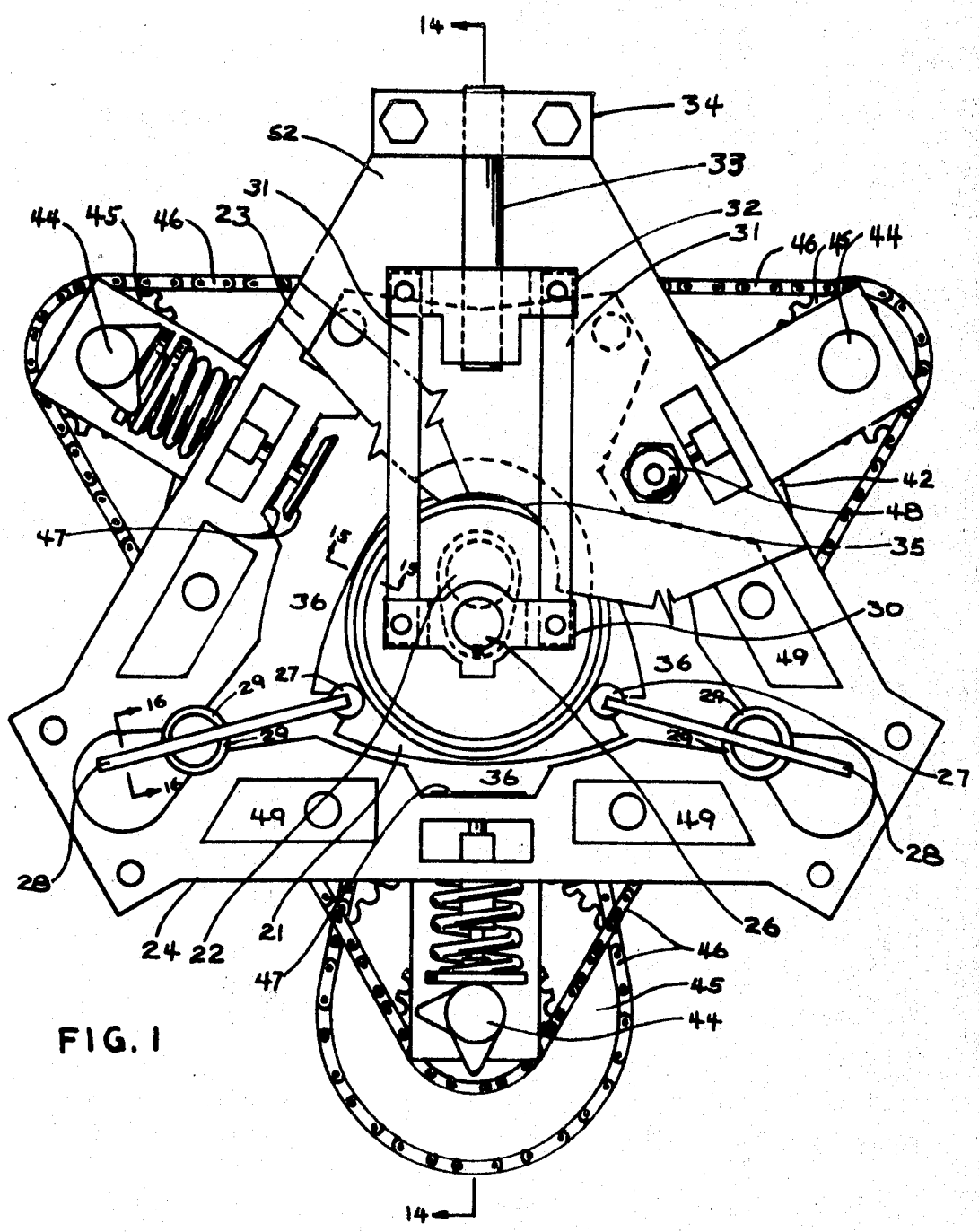
FIG. 1 is a front view partially cut away to show the internal working parts.

In FIG. 1 the piston 21 is substantially triangular in plan to conform to the internal configuration of the block 24. At each of the three corners of the piston 21 is located a circular hinge mechanism 27 which is part of the end of the chamber seal member 28. Said chamber seal members 28 extend from the piston 21 and pass through the half circle seal units 29 which are located in the block 24 and also extend into the front and back wall 23 25 for additional bearing support. Mounted on the center of the piston 21 is an orientation member 26 which extends from the piston 21 through the clearance hole 35 in the front wall member 23 and is secured in the cross member 30 of the piston orientation mechanism 30 31 32 33.

Figure 2:
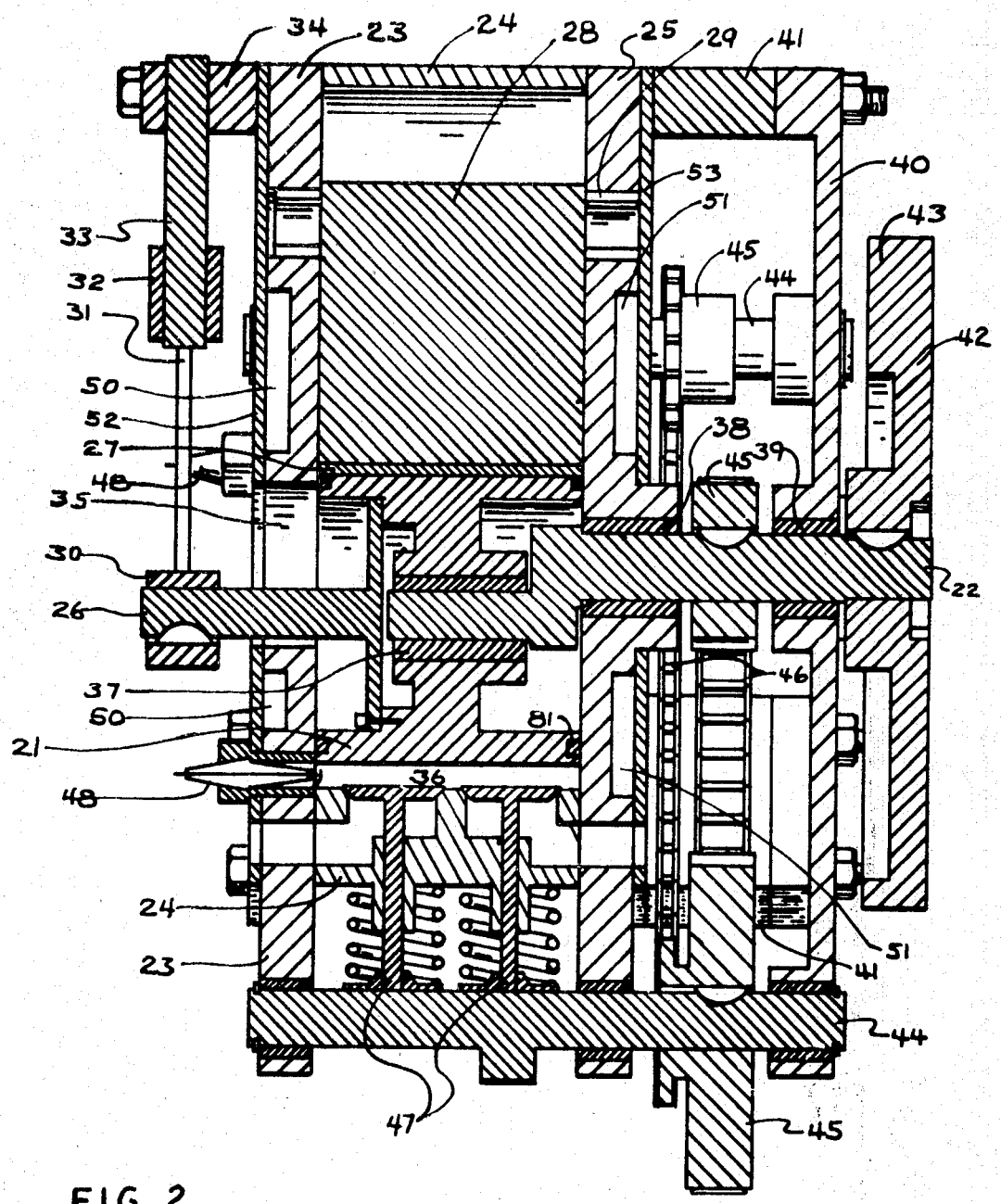
FIG. 2 is a vertical cross section taken on line 14—14 of FIG. 1.

As seen in FIG. 2, the piston 21 is mounted with a suitable bearing 37 on a crankshaft 22 which is mounted in suitable bearings 38 39 in the back wall member 25 and the bearing wall member 40 which is mounted on separator blocks 41. On the output end of the crankshaft 22 is mounted a flywheel 42 with a counter-balance 43 to reduce vibration of the unit when in operation.

The orientation mechanism is comprised of a cross member 30 secured to the orientation member 26, side arms 31 which are pivotally attached to the cross member 30 and to the sliding member 32 which is slidably mounted on a bar 33 attached to the front wall 23 by means of a mount 34.

With the combination of mechanisms described, it is possible for the piston 21 to orbit around the centerline of the crankshaft 22 while remaining in uniform orientation, and with the sliding chamber seal members 28 the three chambers 36 are given an expanding and contracting effect with each revolution of the crankshaft 22. The result is quite similar to that of a reciprocating piston engine.

Also in FIGS. 1 and 2 can be seen the camshafts 44 which are timed to the crankshaft 22 by sprockets 45 and chains 46 to operate the valves 47 for induction and exhausting of gases for the cycles of operation. A spark plug 48 is mounted at each of the three chambers 36 to provide timed ignition of the combustion gases.

Surrounding the combustion chambers 36 and built into the block 24 and front and back wall members 23 25 are cavities 49 50 51 which interconnect. The front wall cavities 50 and the back wall cavities 51 are further covered with plates 52 53 that make the interconnected cavities 49 50 51 a water tight compartment which may contain a circulating cooling liquid such as water to dissipate the engine heat created by combustion. This circulating fluid may be further cooled by means of a standard radiator connected to the water compartments.

Figure 3:
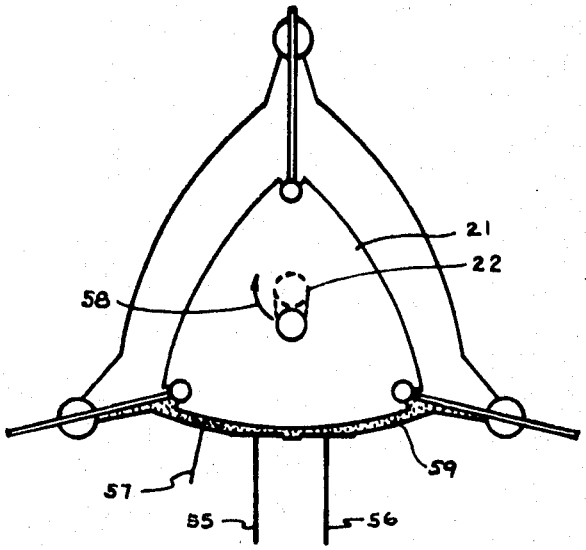
FIGS. 3, 4, 5, 6 are sequence schematic drawings of the four cycles.
Figure 4:
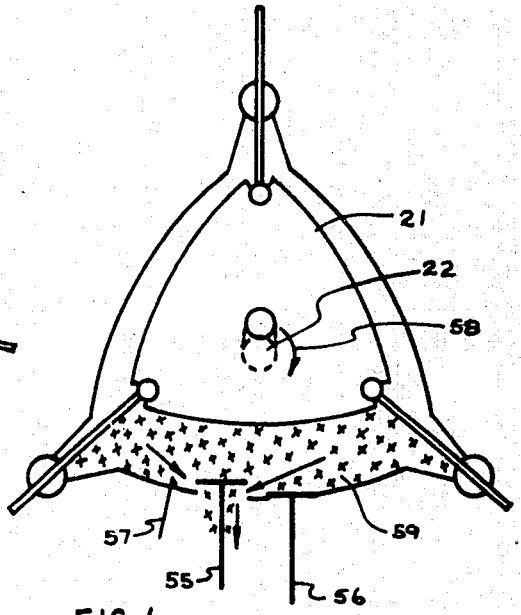
Figure 5:
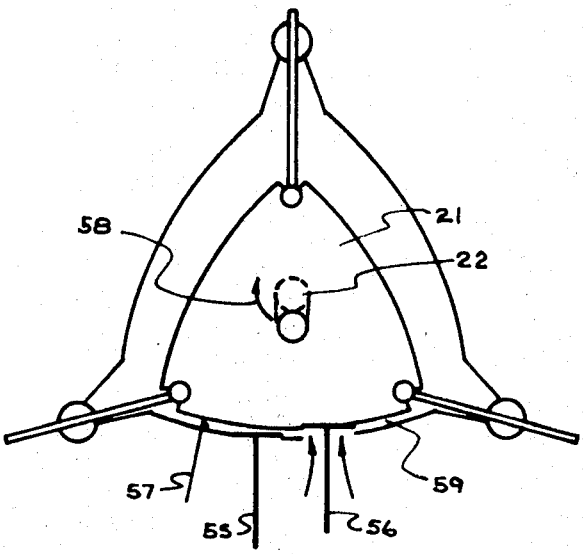
Figure 6:
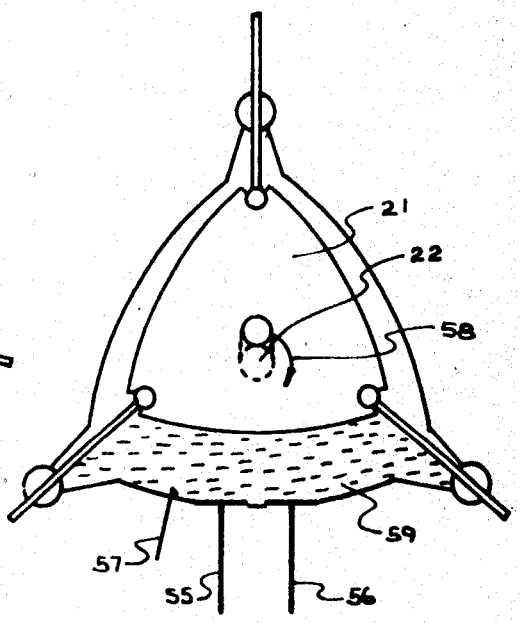

In the sequence schematic drawings 3, 4, 5, 6, as the compressed gas in FIG. 3 is ignited by the spark plug 57, the piston 21 is forced to orbit around on its power stroke in the path of the arrow 58 to where in FIG. 4 the exhaust valve 55 has been opened; and as the piston 21 continues to orbit, it expels the exhaust gases until at FIG. 5 the exhaust has been expelled, the exhaust valve 55 closed, and the intake valve 56 opened so fresh fuel is inducted as the piston again continues its orbit to where the intake valve 56 closes at FIG. 6 and the piston 21 compresses the fuel as it continues to orbit until it is back at FIG. 3 and the cycle again repeats.

By changing the timing of the valves 55 56 in FIGS. 3, 4, 5, 6 to a one to one ratio with the crankshaft 22 and applying steam or air pressure through the valves 55 56 to the chambers 59, the unit will convert said pressure to rotary power and have the advantage of a no-dead-center stopping point.

Figure 7:
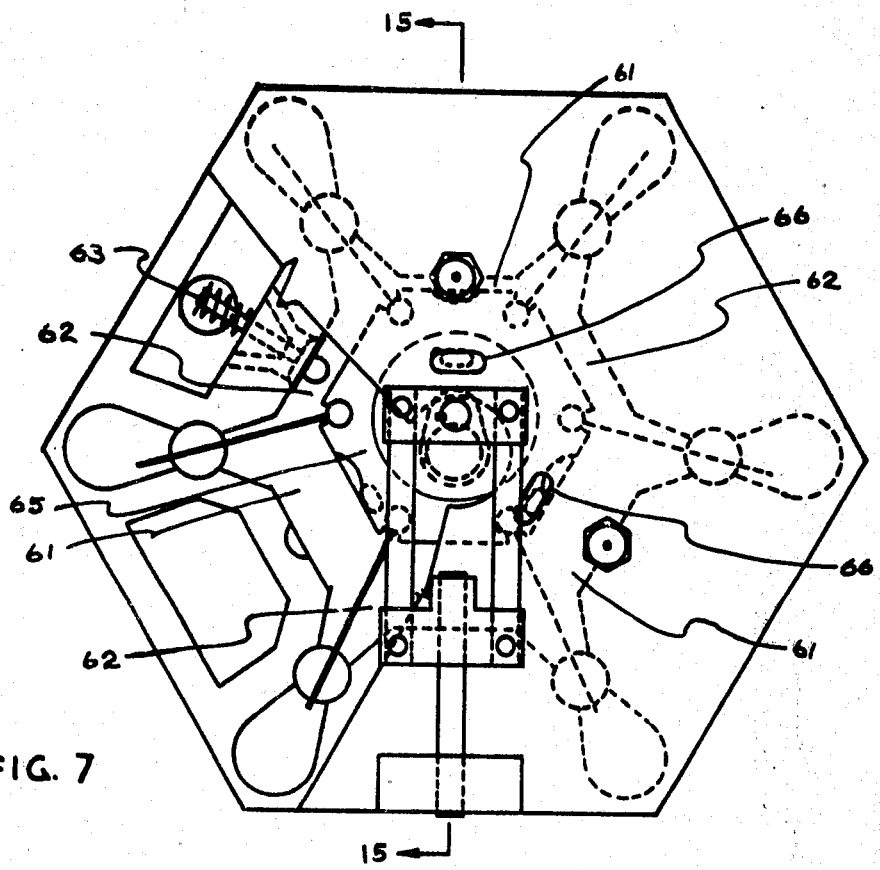
FIG. 7 is a front view partially cut away to show the engine as a two-cycle unit.
Figure 8:
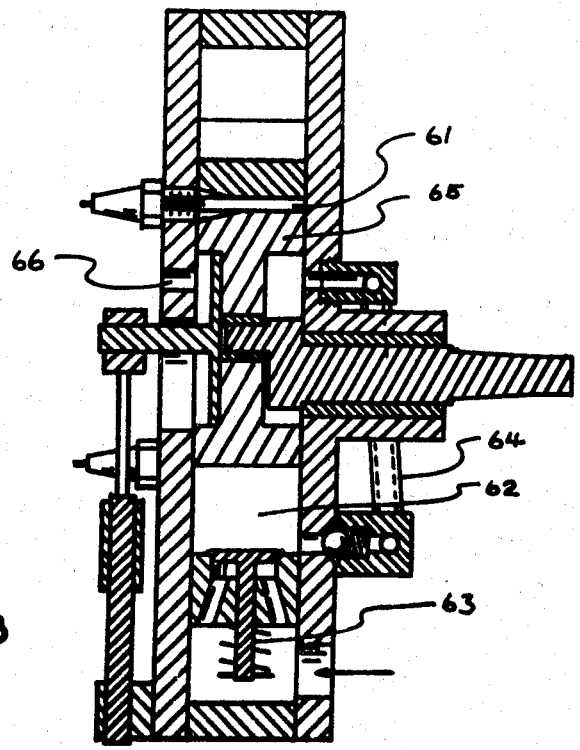
FIG. 8 is a vertical cross section taken on line 15—15 of FIG. 7.

In referring to FIGS. 7 and 8, the roto-reciprocating engine is drawn as a six-chamber unit with opposite chambers 61 and 62 serving as a working unit giving the engine three induction chambers 62 and three firing chambers 61. Each of the three induction chambers 62 is provided with an intake valve 63 to allow fresh gas to be drawn into the induction chamber 62 as it is expanded by movement of the piston 65. Also provided is a communicating pipe or channel 64 between each induction chamber 62 and the opposing firing chamber 61. Through this channel 64 the compressed gas in the induction chamber 62 is transferred to the firing chamber 61 when the firing chamber 61 is in its expanded position and as the exhaust gases simultaneously escape from the firing chamber 61 through the exhaust ports 66.

Figure 9:
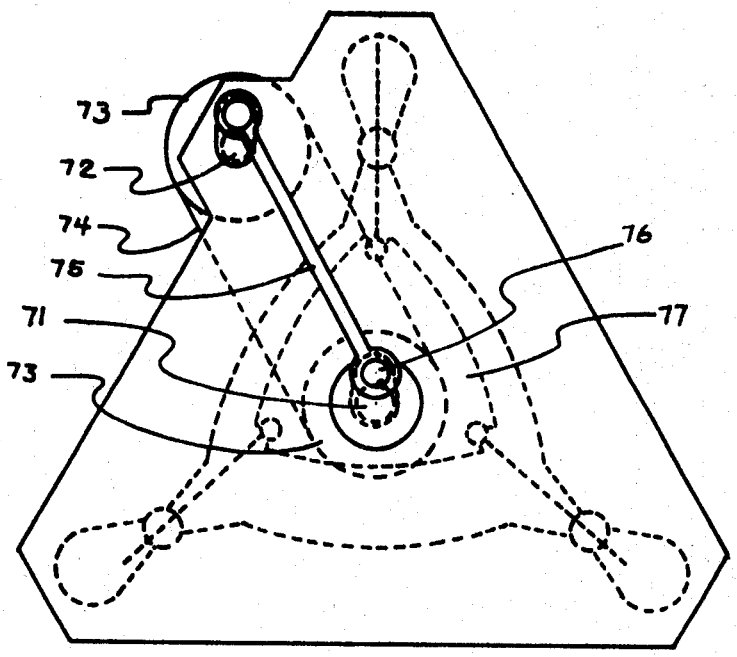
FIG. 9 is a diagramatic view to show dual crankshaft used for piston orientation.

As seen in FIG. 9 the roto-reciprocating engine has the power crankshaft 71 and an auxiliary crankshaft 72. They are timed in a one to one ratio to each other by means of sprockets 73 and chain 74. Between the two crankshafts 71 72 is mounted an orientation bar 75 which is secured to the piston orientation member 76 at the one end and has a sliding fit or bearing on the auxiliary shaft 72. This allows the piston 77 to orbit but not rotate.

Figure 10:
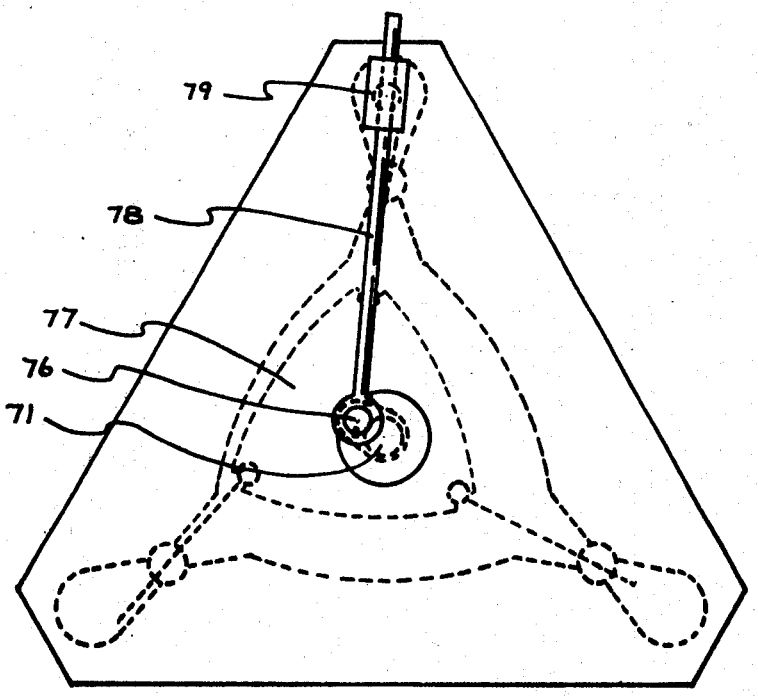
FIG. 10 is a diagramatic view to show a sliding bar piston orientation mechanism.

Another orientation means is shown in FIG. 10 in which the piston 77 has a bar 78 secured to the orientation member 76 and the bar 78 slides through a pivotally mounted bearing 79 which gives slight out-of-true orientation movement as the piston 77 orbits on the crankshaft 71.

Figure 11:
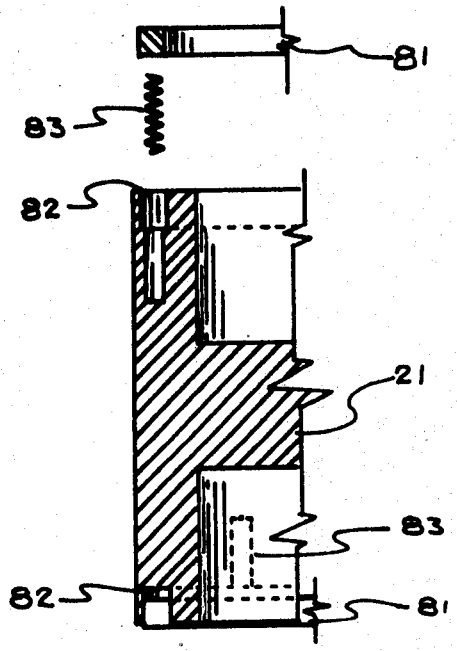
FIG. 11 shows cross section detail on line 15—15 of FIG. 1 of piston sealing means in a partially exploded view.

In FIG. 11 is seen a partial cross section of the piston 21 of FIG. 1 taken along the lines 15—15. The sealing ring 81 is fitted into the ring groove 82 in the piston with pressure supplied by springs 83 located behind said ring 81.

Figure 12:
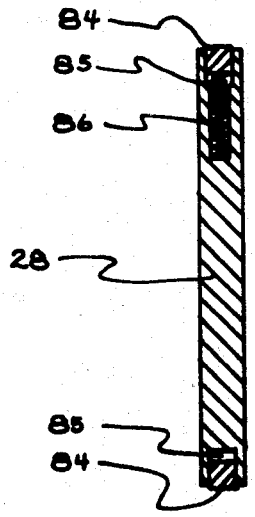
FIG. 12 shows cross section detail of chamber seal with sealing means taken on line 16—16 of FIG. 1.

The chamber seals 28 as seen in FIGS. 1 and 12 have a sealing member 84 fitted in a groove 85 and supplied contact pressure by springs 86.

Figure 13:
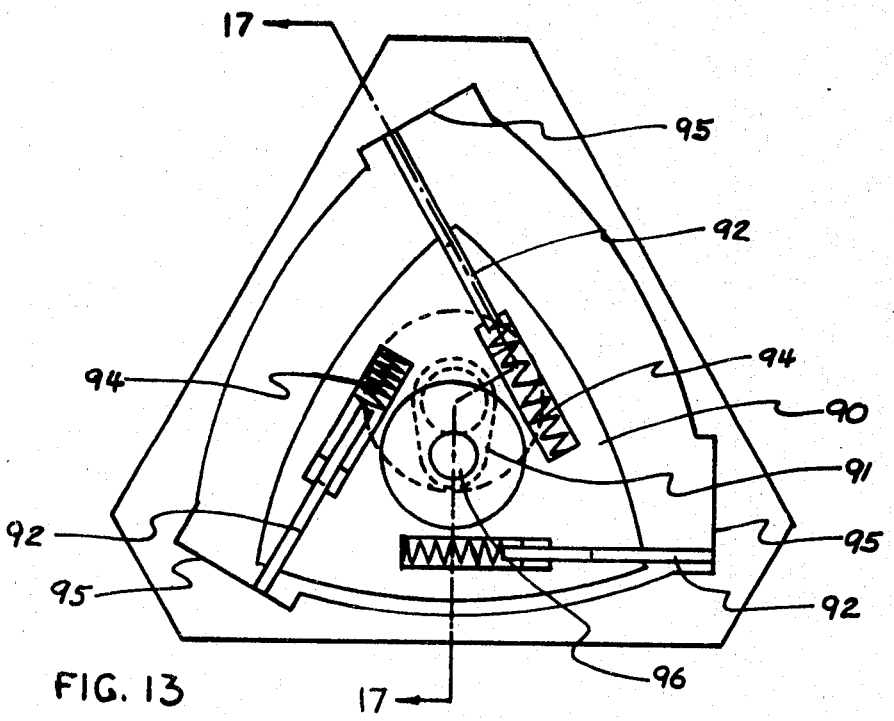
FIG. 13 shows a variation of chamber seal.
Figure 14:
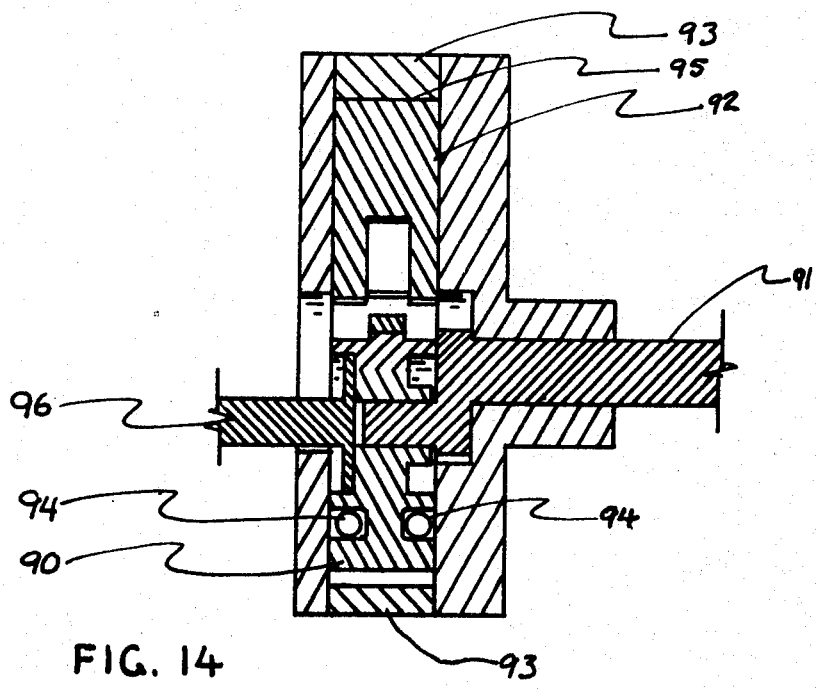
FIG. 14 is a cross section of FIG. 13 on line 17—17.

FIGS. 13 and 14 show a chamber seal variation as applied to the roto-reciprocating engine with FIG. 13 showing the engine with the front wall removed and FIG. 14 being a cross section along broken line 17—17 of FIG. 13. In this application the chamber seal members 92 are made so they retract into the piston 90 and are held in sealing contact with the block 93 by the use of springs 94. In this application the chamber seal members 92 are provided with a flat contact surface 95 in the block 93. The crankshaft 91 and orientation member 96 function as in the other manifestations of the engine shown in preceding views.

What I claim is:

1. In an orbital engine, block means having a back wall, a front wall and a peripheral wall forming a cavity, the back wall having a crankshaft opening, the front wall having a clearance opening, piston means mounted for orbital movement in the chamber, sealing means connected to the piston means and forming a plurality of chambers with the piston means and the back, front and peripheral walls, a crankshaft connected to the piston means and extending through the crankshaft opening, the piston means being movable in the cavity in a predetermined orbit and covering the clearance opening throughout the orbit, an orientation member keyed to the piston means and extending from the piston means into the clearance opening, and guide means mounted movably on the block means and positioned exteriorly of the block means and keyed to the orientation member, the guide means permitting free orbital movement of the piston means and preventing rotation thereof relative to the block means.

2. The orbital engine of claim 1 wherein the orientation member is a pin centered on the piston means.

3. The orbital engine of claim 2 wherein the guide means includes crankshaft means, means mounting the crankshaft means rotatably on the block means, synchronizing means drivingly connecting the crankshaft and the crankshaft means, and connecting rod means keyed to the pin and rotatably connected to the crankshaft means.

4. The orbital engine of claim 2 wherein the guide means comprises arm means keyed to the pin and means mounting the arm means for pivotal and sliding movement relative to the block means.

5. The orbital engine of claim 4 wherein the arm means comprises a rod slidable and pivotally connected to the block means.

6. The orbital engine of claim 4 wherein the arm means includes a parallelogram linkage means connected to the pin and means connecting the parallelogram linkage means pivotally and slidably to the block means.

7. In a two-cycle orbital engine, block means having a cavity, piston means orbital in the cavity, orientation means preventing rotation of the piston means in the cavity, sealing means forming with the block means and the piston means a plurality of crossed pairs of opposed chambers, one chamber of each pair being a firing chamber and the other chamber of each pair being a crankcase chamber and being diametrically opposed to the firing chamber, each firing chamber including an exhaust port and an intake port opened by the piston means near the end of its power stroke relative to that chamber, means for supplying a combustible mixture to each crankcase chamber, each exhaust port being closed by the piston means during the early part of the compression stroke thereof, ignition means in each firing chamber, and crankshaft means connected to the piston means and driven thereby, the crankshaft means and the orientation means causing the piston means to move orbitally as the firing chambers are fired one after another.

8. The two-cycle orbital engine of claim 7 wherein there are three pairs of opposed chambers.

9. The two-cycle orbital engine of claim 7 wherein the block means has a front wall provided with a clearance opening always closed by the piston means, the orientation means comprising an orientation member keyed to the piston means and extending through the clearance opening, a guide member external of the block means and keyed to the orientation member, and guide means on the block means and guiding the guide member to confine movement of the orientation member to an orbital path.

* * * * *